US008123036B2

(12) United States Patent
Luciano, Jr. et al.

(10) Patent No.: US 8,123,036 B2
(45) Date of Patent: Feb. 28, 2012

(54) PILL ASSEMBLY FOR PILL PACKAGING AND DELIVERY SYSTEMS

(75) Inventors: Robert A. Luciano, Jr., Reno, NV (US); Lawrence W. Luciano, Somerville, NJ (US)

(73) Assignee: Edge Medical Properties, LLC, Reno, NV (US)

( * ) Notice: Subject to any disclaimer, the term of this patent is extended or adjusted under 35 U.S.C. 154(b) by 496 days.

(21) Appl. No.: 11/241,783

(22) Filed: Sep. 30, 2005

(65) Prior Publication Data

US 2006/0086640 A1 Apr. 27, 2006

Related U.S. Application Data

(60) Provisional application No. 60/615,267, filed on Oct. 1, 2004.

(51) Int. Cl.
*B65D 73/00* (2006.01)
*B65D 83/04* (2006.01)
*B65D 85/42* (2006.01)

(52) U.S. Cl. ..... 206/534; 206/534.1; 206/538; 206/468

(58) Field of Classification Search ..... 206/467, 206/468, 528, 530–532, 534, 534.1, 536, 206/538, 540, 828
See application file for complete search history.

(56) References Cited

U.S. PATENT DOCUMENTS

| | | | | |
|---|---|---|---|---|
| 3,933,245 | A | 1/1976 | Mullen | |
| 4,039,080 | A | 8/1977 | Cappuccilli | |
| 4,062,445 | A * | 12/1977 | Moe | 206/1.5 |
| 4,318,477 | A | 3/1982 | Kerpe | |
| 4,535,890 | A * | 8/1985 | Artusi | 206/530 |
| 4,693,371 | A | 9/1987 | Malpass | |
| 4,749,085 | A | 6/1988 | Denney | |
| 4,799,590 | A * | 1/1989 | Furman | 206/390 |
| 4,850,489 | A | 7/1989 | Weithmann et al. | |
| 5,186,345 | A * | 2/1993 | Ching An | 220/23.4 |
| 5,390,796 | A | 2/1995 | Kerfoot, Jr. | |
| 5,878,887 | A * | 3/1999 | Parker et al. | 206/528 |
| 6,460,693 | B1 * | 10/2002 | Harrold | 206/1.5 |
| 6,662,081 | B1 * | 12/2003 | Jacober et al. | 700/242 |
| 2004/0069674 | A1 * | 4/2004 | Siegel | 206/538 |
| 2004/0069675 | A1 * | 4/2004 | Stevens | 206/538 |
| 2004/0256277 | A1 * | 12/2004 | Gedanke | 206/538 |

FOREIGN PATENT DOCUMENTS

DE 3502647 A1 * 7/1986

* cited by examiner

*Primary Examiner* — Jila Mohandesi
*Assistant Examiner* — Melissa Lalli
(74) *Attorney, Agent, or Firm* — Kerr IP Group, LLC; Michael A. Kerr

(57) ABSTRACT

A pill assembly configured to receive the correct selection of medications in the correct dosages for a particular patient. The pill assembly comprises containers wherein at least one of the containers is configured to receive a plurality of different pills. The containers are adjacent to one another. The pill assembly also comprises a plurality of lids. Each of the lids is configured to seal a corresponding container. The containers have a top surface with a flange that is configured to receive the corresponding lid. Each lid has a surface that is configured to receive a printable indicia with patient specific information. The pill assembly may also comprise a sleeve that is configured to slidably interface with the containers.

20 Claims, 17 Drawing Sheets

First Name

Last Name

Address

Height

Weight

Sex

Date

Telephone

Medical Conditions

E-mail

Doctor Information

Drug Allergies

Current Medications

Ordering Options (otherwise child resistant)

Requested Medications

| Product: | Dosage: | Quantity: | Type | Price |
|---|---|---|---|---|
| | | | O Generic<br>O Name Brand | |
| | | | O Generic<br>O Name Brand | |
| | | | O Generic<br>O Name Brand | |
| | | | Sub-Total | |
| | | | Shipping | |
| | | | Order Total | |

Credit Card Information

Name:

Number:

Type of Card:

Expiration Date:

*Fig. 15*

PILL ASSEMBLY FOR PILL PACKAGING AND DELIVERY SYSTEMS

CROSS-REFERENCE TO RELATED APPLICATIONS

This application claims benefit under 35 U.S.C. 119(e) of U.S. Provisional Application No. 60/615,267, filed Oct. 1, 2004, which is incorporated herein by reference in its entirety.

BACKGROUND

1. Field

This description relates to the field of pill packaging and delivery systems. More particularly, this description relates to a pill assembly, an apparatus for storing pills, and a method for dispensing pills.

2. Description of Related Art

One of the major problems in the taking of prescribed daily medications emanates from the fact that, in many instances the patient has to take more than one medication in the form of tablets or pills. The concern is based on determining whether all medications have been taken in compliance with the prescribed daily regimen. Many times this concern is compounded by the requirement that portions of the various medications must be taken at different times during the day.

The fear of taking improper dosages of prescribed medication can be particularly acute in the elderly, many of whom have some degree of mental dementia and can easily be confused as to whether they have taken all of their medications at the correct time. Some patients, with curtailed mental capabilities, have difficulty just in sorting out the medications preparatory to taking them, let alone taking the medication in a timely manner. Providing medications to disabled and/or incapacitated individuals can also be a problem for care givers, particularly those in hospitals and assisted living facilities where one caregiver may oversee the medication of many patients.

Thus, there is a need for a positive delivery system and pill package assembly for the delivery of multi-prescription dosages. A pill packaging and delivery system which could decrease the possibility of human error and provide an easy to use set-up for the correct selection and delivery of multi-tablet/multi-time medications would be welcomed by the pharmaceutical and medical communities.

There is also a need for a pill delivery system that could provide evidence that the prescriptions were actually taken or administered as prescribed. Such a system would be an efficient way for any patient to take such multi-dosages but it would be especially beneficial for a patient of limited mental capacity as well as to caregivers in the hospital setting.

There is also a need for a pill assembly and delivery system for vitamin supplements. Vitamin supplements are also often used in the same manner as many prescribed drug regiments with many of the same problems and inconveniences. Therefore a delivery system that addresses the needs of multi-prescription administration also contains many benefits for, and can be applied to, the vitamin and herbal supplement market.

SUMMARY

A pill assembly configured to receive the correct selection of medications in the correct dosages for a particular patient. The pill assembly comprises containers wherein at least one of the containers is configured to receive a first pill associated with a first medication and a second pill with a second medication. The containers are adjacent to one another and have a top surface with a flange thereon. The pill assembly also comprises a plurality of lids that are configured to interface with the flange of the container. Each of the lids is configured to seal a corresponding container. The containers have a top surface with a flange that is configured to receive the corresponding lid. Each lid has a surface that is configured to receive a printable indicia with patient and prescription specific information.

The pill assembly may also comprise a sleeve that is configured to slidably interface with the containers. The sleeve may also be configured to receive a folded label with information about each pill in the containers. Each individual container of the pill assembly may be sequentially identified by the specific date and time at which the medication is to be taken by the patient. Additionally, the sleeve may be configured to provide "child proofing" of the finished package, and additional space for compliance labeling.

The pill assembly is configured to allow dispensing of pills into the individual containers by an automated system which is connected to a computer data system that contains the patient's medical prescription information. The pill assembly is labeled with patient information and prescription data automatically.

Additionally, a method for dispensing pills is described. The method comprises providing containers that are adjacent to one another and have a top surface with a flange. The method to fill at least one of the containers with a first pill associated with a first medication and a second pill associated with a second medication. The first medication and second medication are associated with a particular individual. The method then seals the containers with lids that are configured to interface with the flange of the corresponding container. The method then proceeds to write on each of the plurality of lids information related to the particular individual. Additionally, a sleeve may be provided to interface with the plurality of containers, to provide a child safety tab (to create a child resistant package), to provide a means for compliant dispensing, to provide space to receive a folded label with compliant labeling, and to interface with other sleeves.

These and other advantages and features of the invention will become apparent to those persons skilled in the art upon reading the details of the pill assembly for multiple pill packaging and delivery systems as more fully described below.

DRAWINGS

The present invention will be more fully understood by reference to the following drawings which are for illustrative, not limiting, purposes.

Figure 3A:
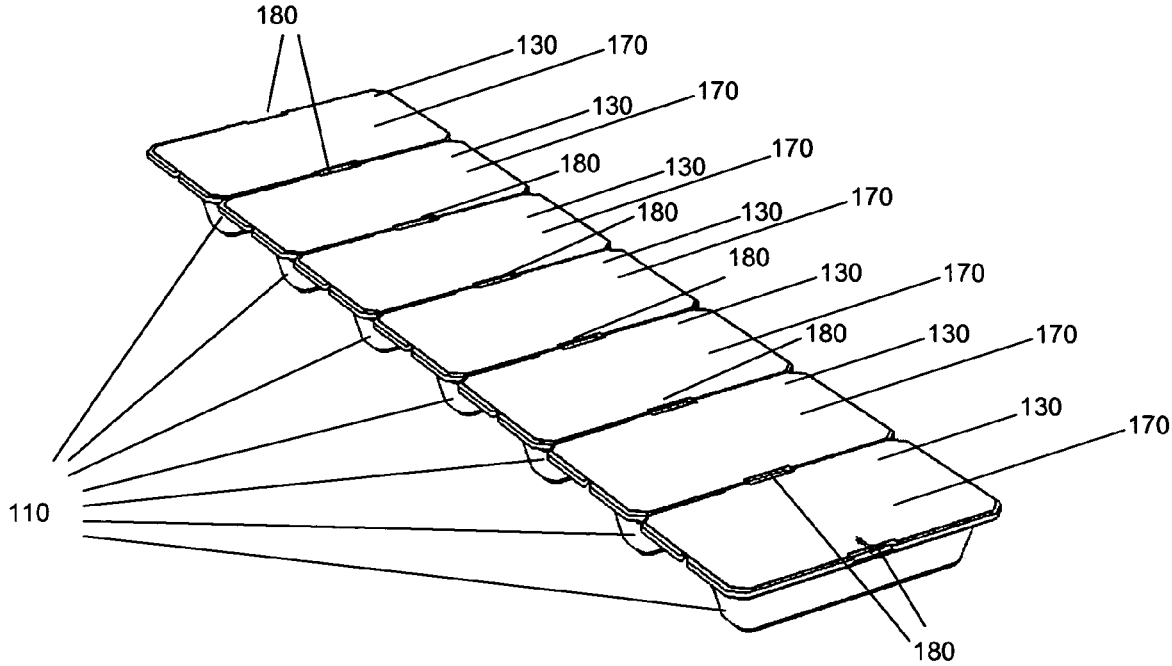
Figure 3B:
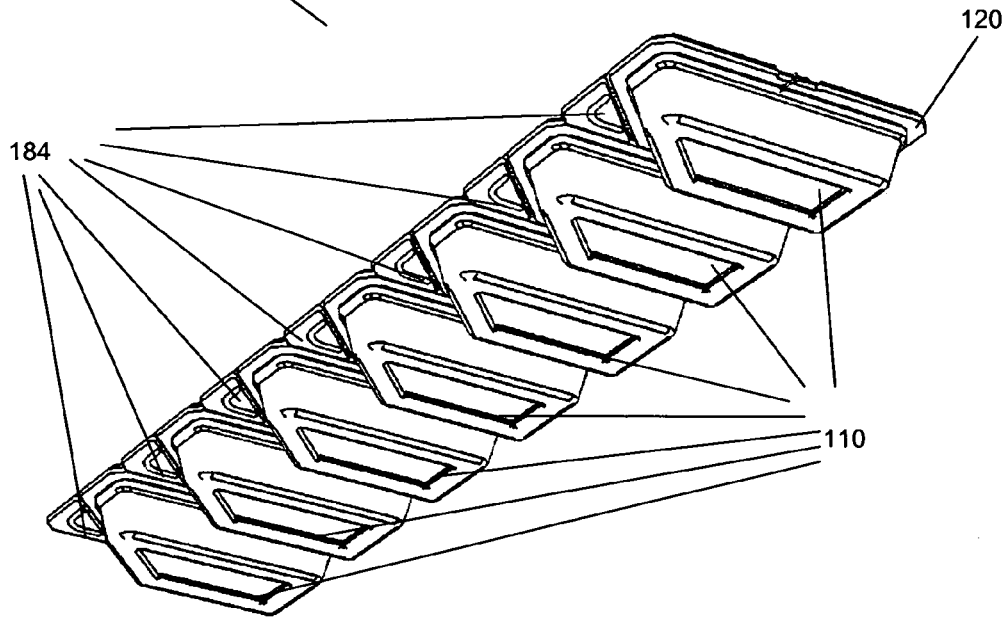

FIGS. 3*a* and 3*b* show a top view and a bottom view of one embodiment of a plurality of individual containers which are connected to each other by perforated joints of a lid stock.

Figure 4:
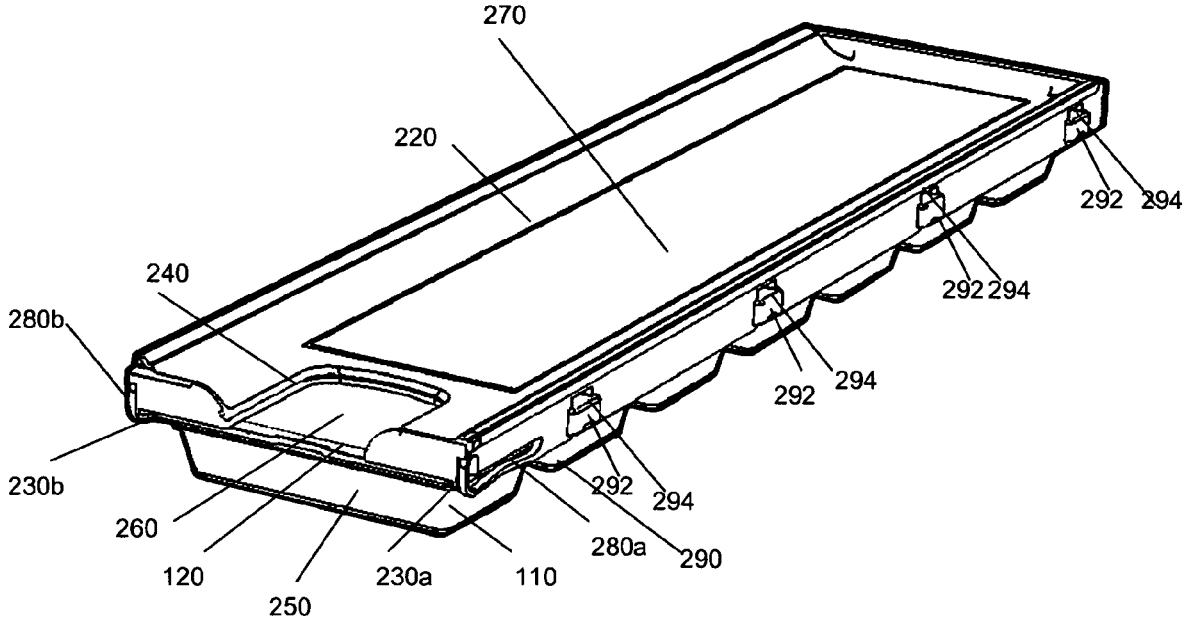

FIG. 4 shows a diagram of one embodiment of a pill assembly.

Figure 5A:
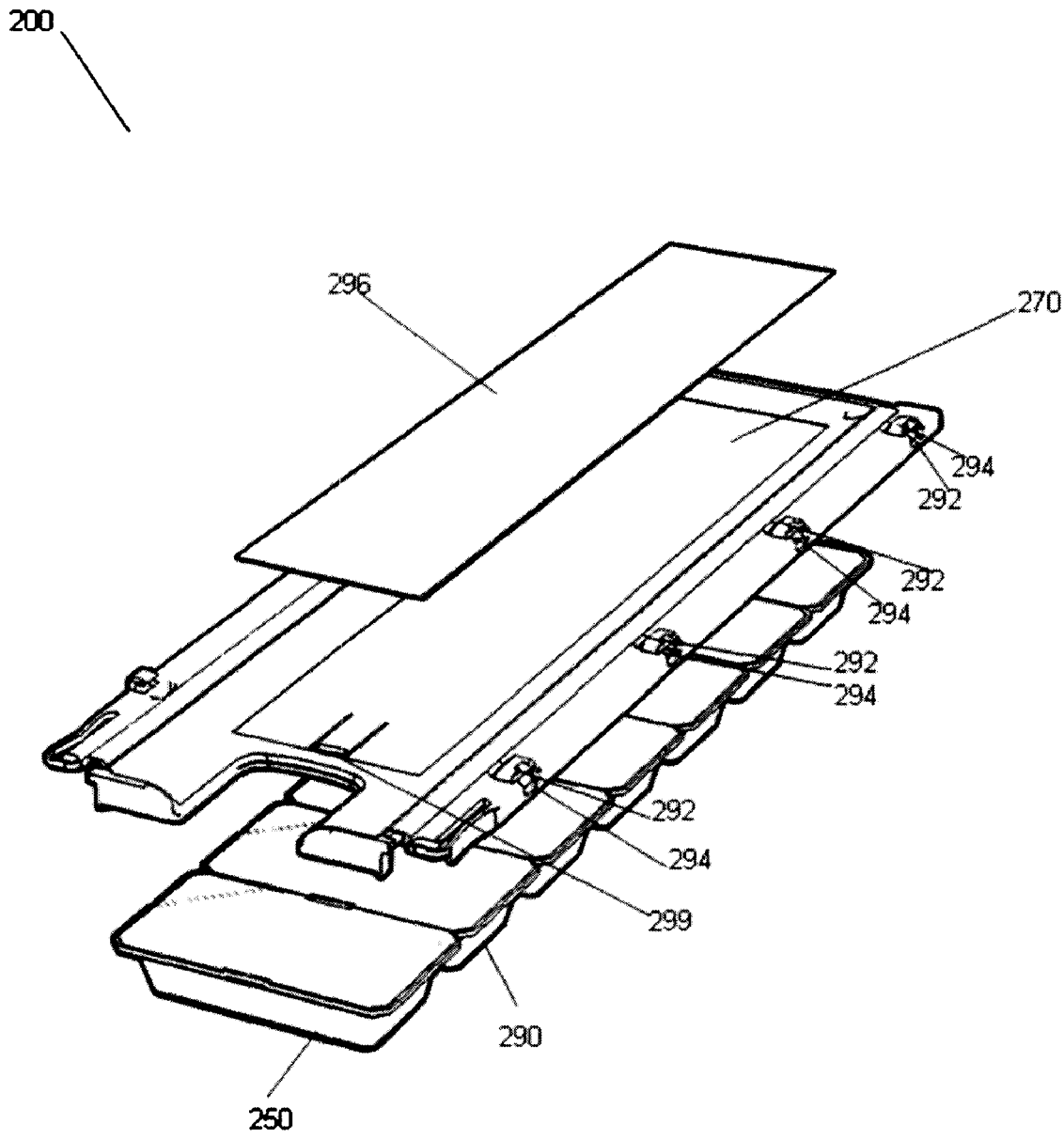
Figure 5B:
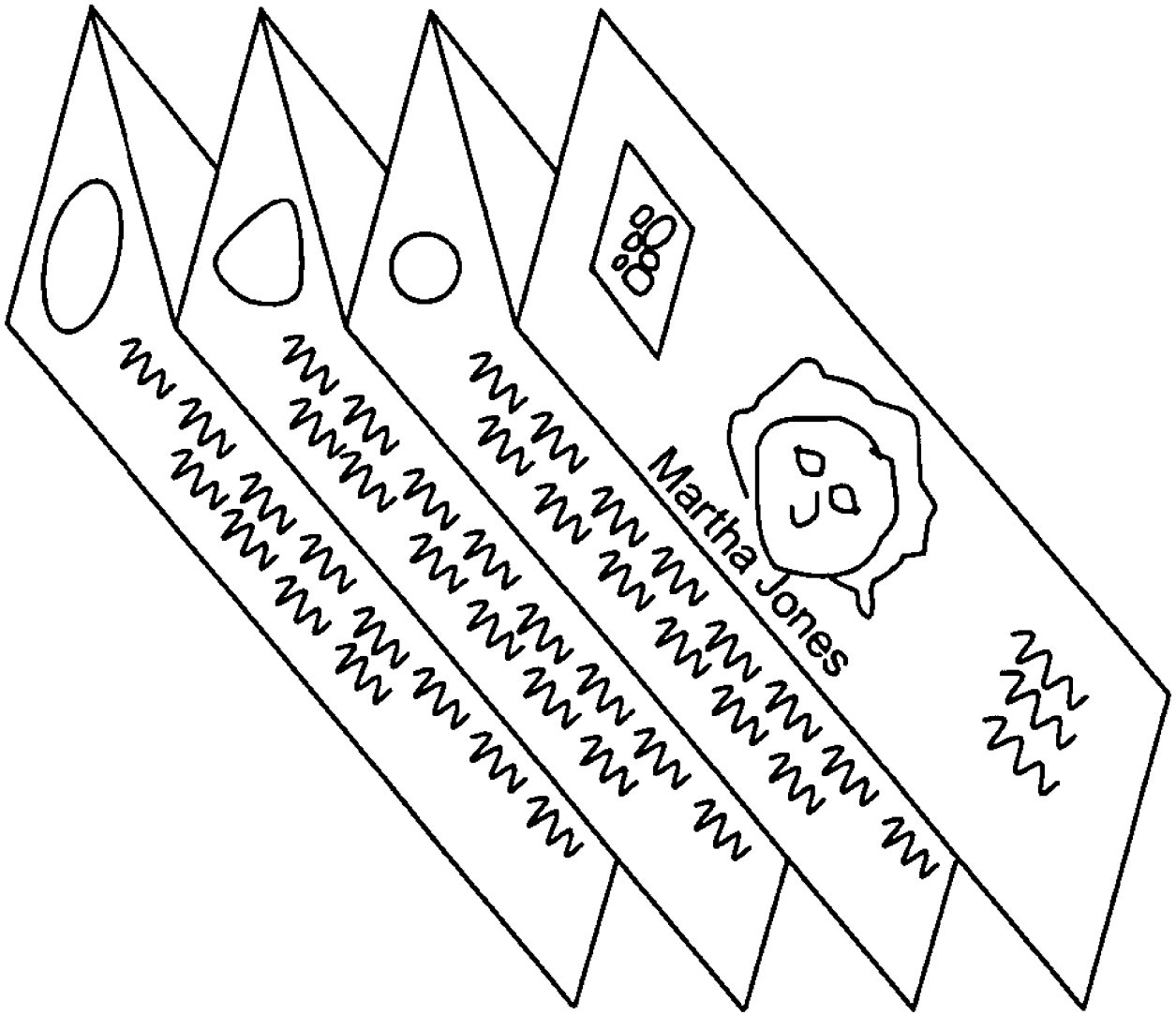

FIG. 5*a* shows an exploded top view of a pill assembly prior to the attachment of the dispensing sleeve to the group of containers in accordance with the invention FIG. 5*b* shows a folded label that is received the sleeve in FIG. 5*a*

Figure 6:
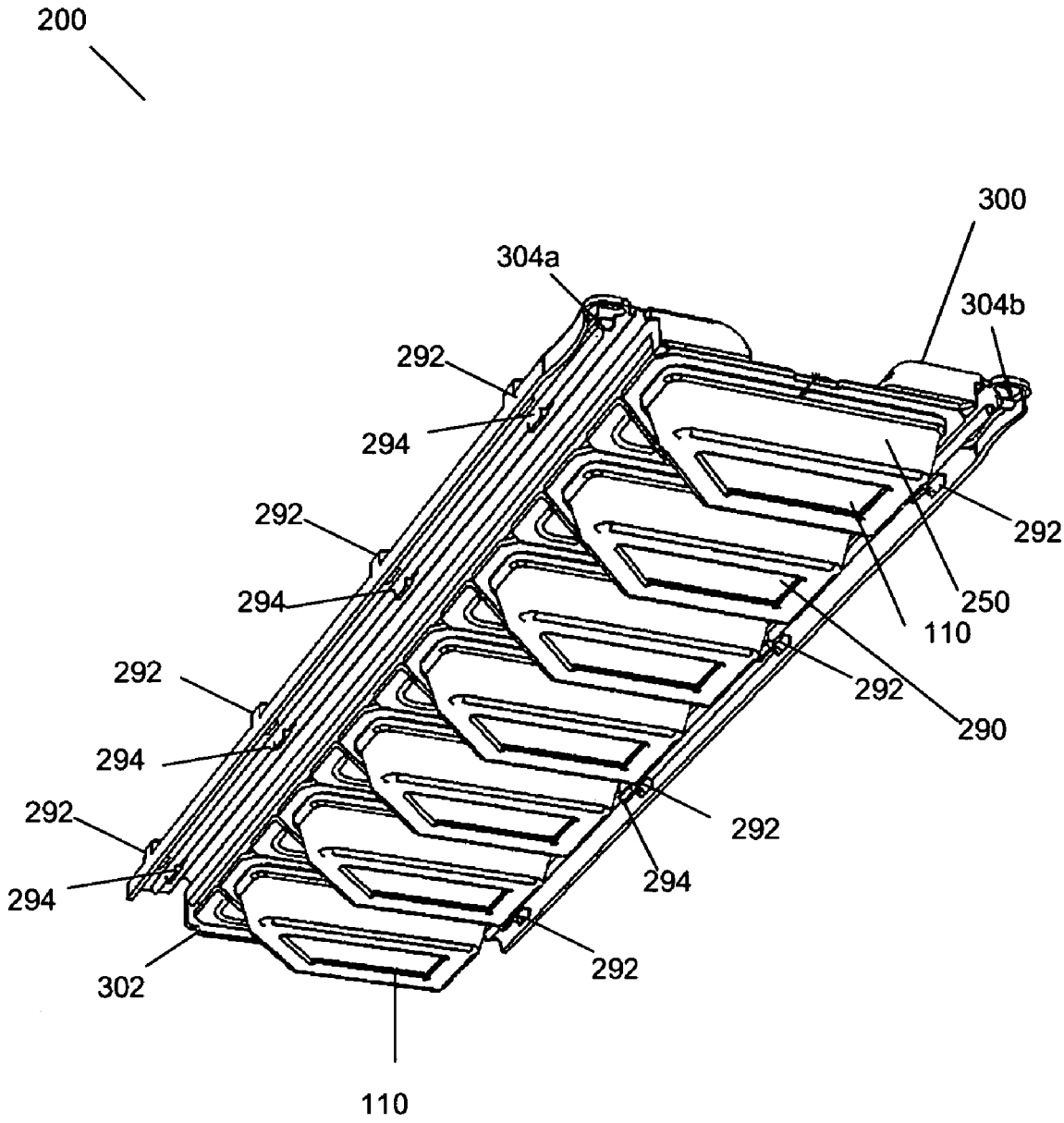

FIG. 6 is a top view of the pill assembly in FIG. 5 prior to the attachment of the dispensing sleeve to the containers.

Figure 7:
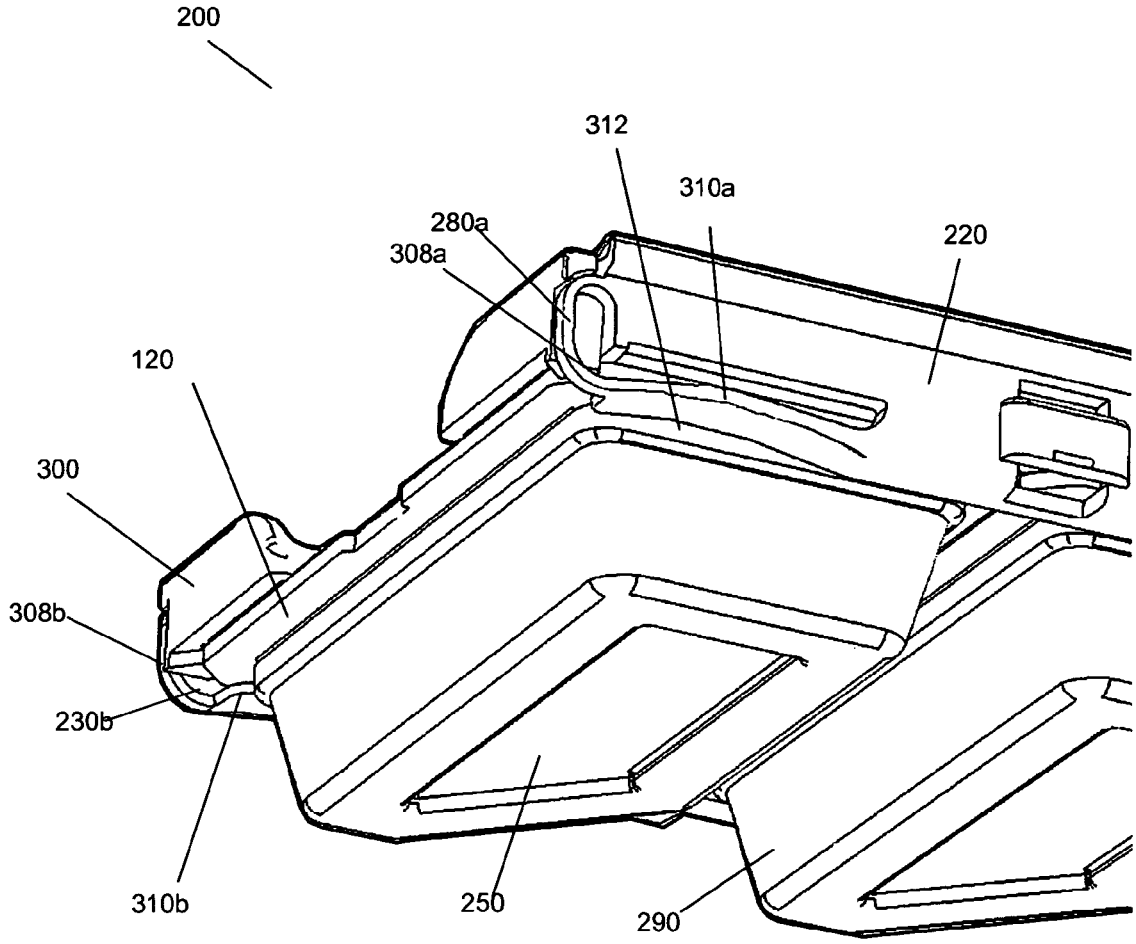

FIG. 7 is an end perspective of one embodiment of pill assembly showing a child protection feature in accordance with the invention.

Figure 8A:
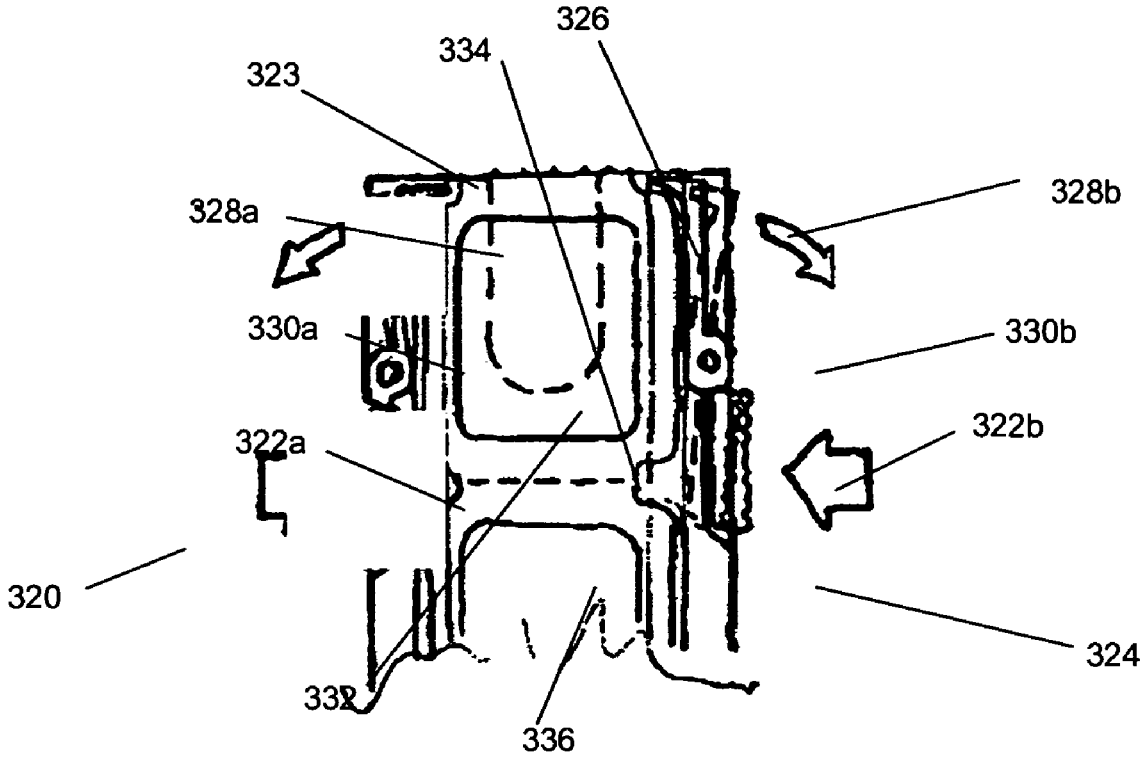

FIG. 8*a* shows a diagram of a bottom view of one embodiment of a pinch release tab.

Figure 8B:
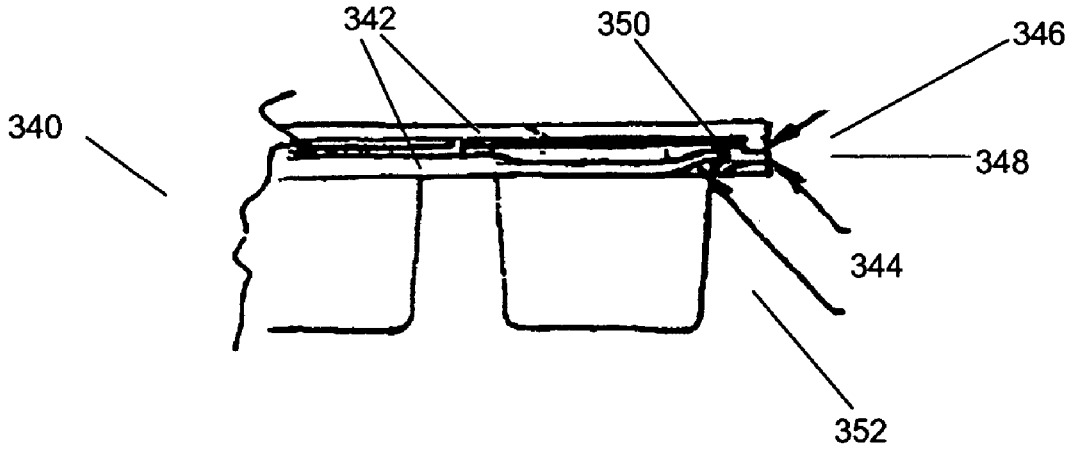

FIG. 8*b* shows a diagram of a side view of one embodiment of a push-down release tab.

Figure 9A:
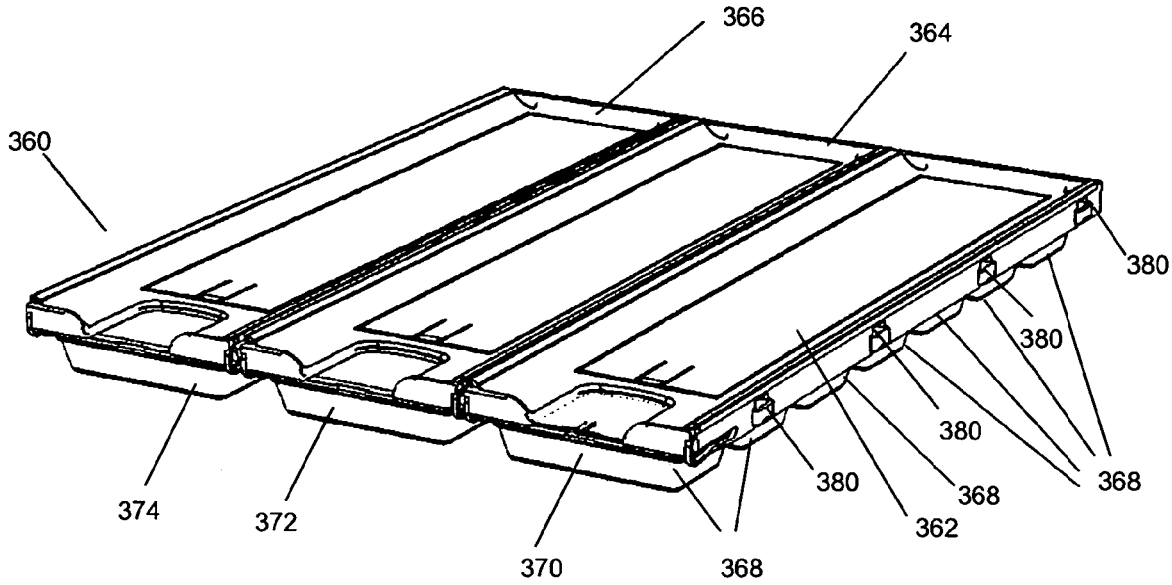

FIG. 9*a* shows one embodiment of a plurality of pill assemblies interlocked together.

Figure 9B:
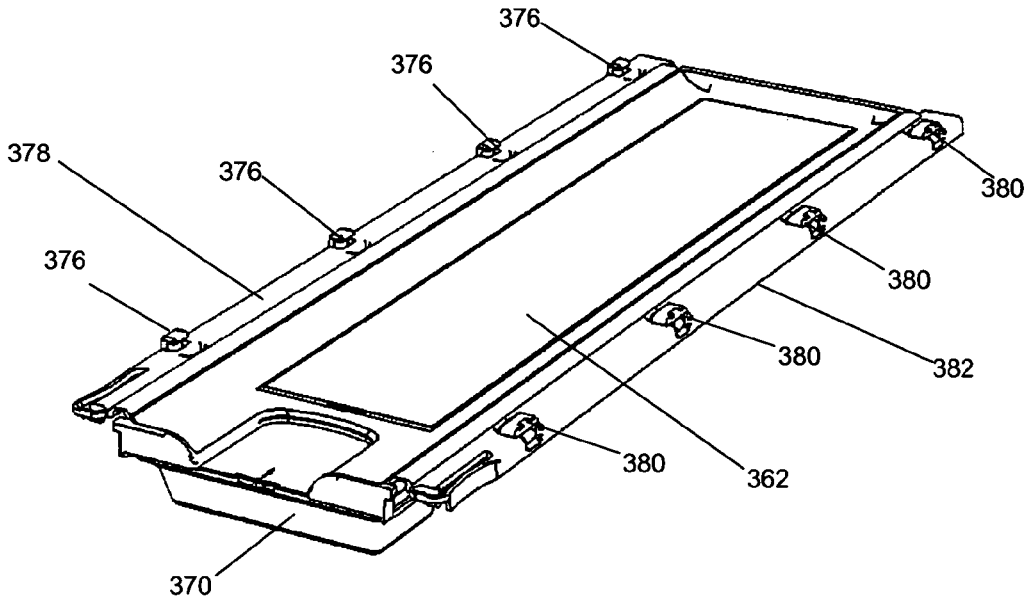

FIG. 9*b* shows a side view of interlocking means of the pill assembly of FIG. 9*a*.

Figure 10A:
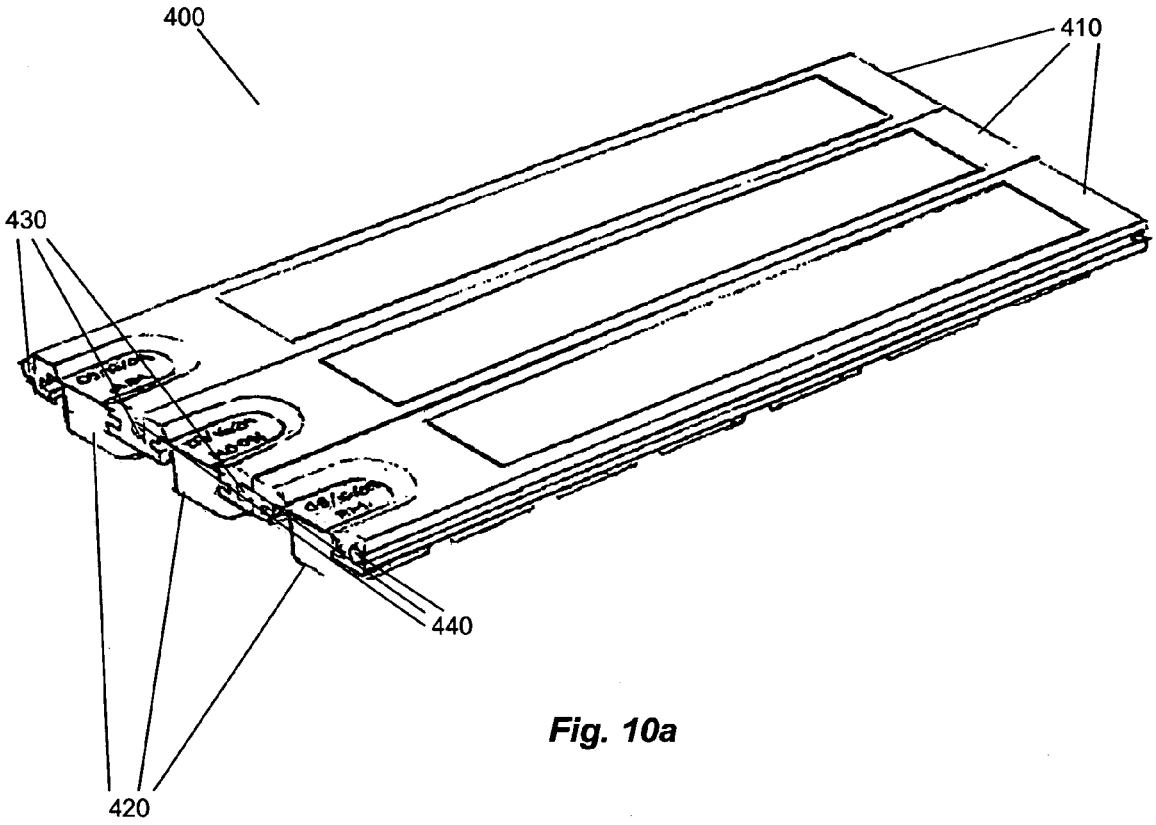
Figure 10B:
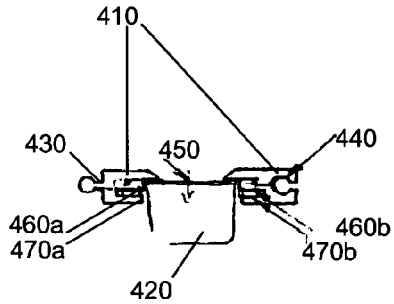

FIGS. 10*a* and 10*b* are diagrams showing another embodiment of a plurality of pill assemblies interlocked together.

Figure 11:
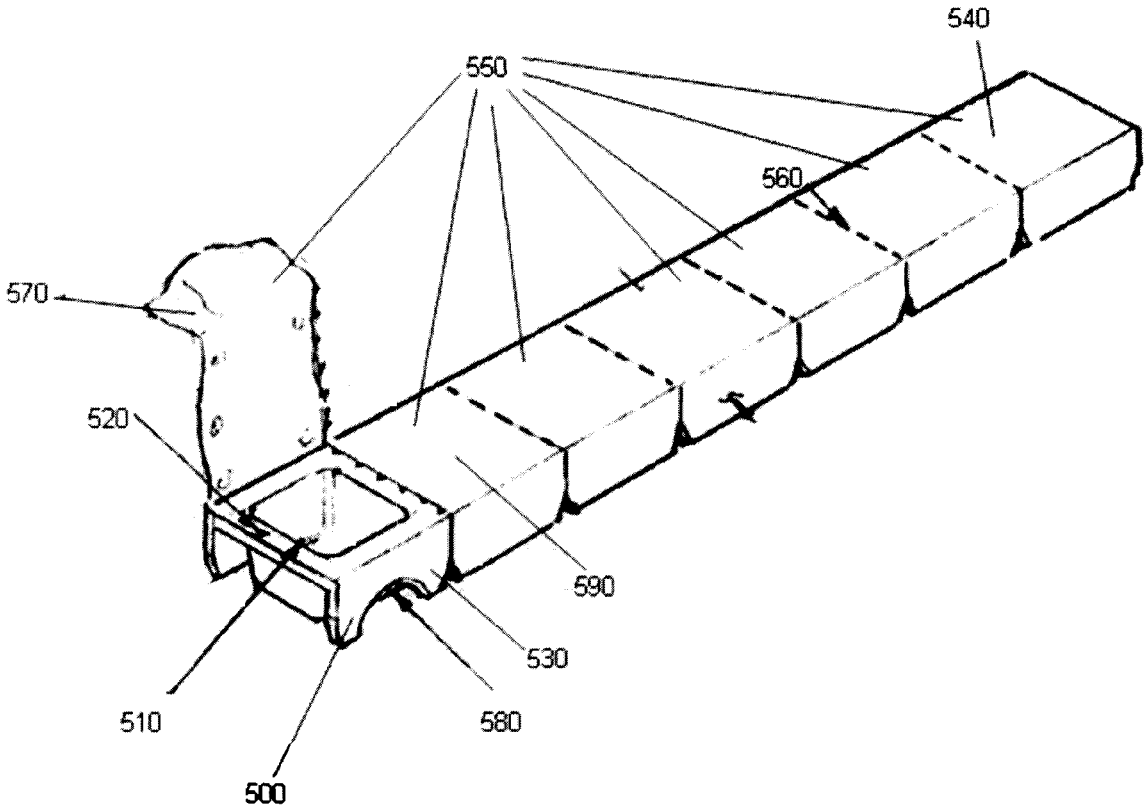

FIG. 11 is a diagram showing one embodiment of a "senior friendly" pill assembly.

Figure 12:
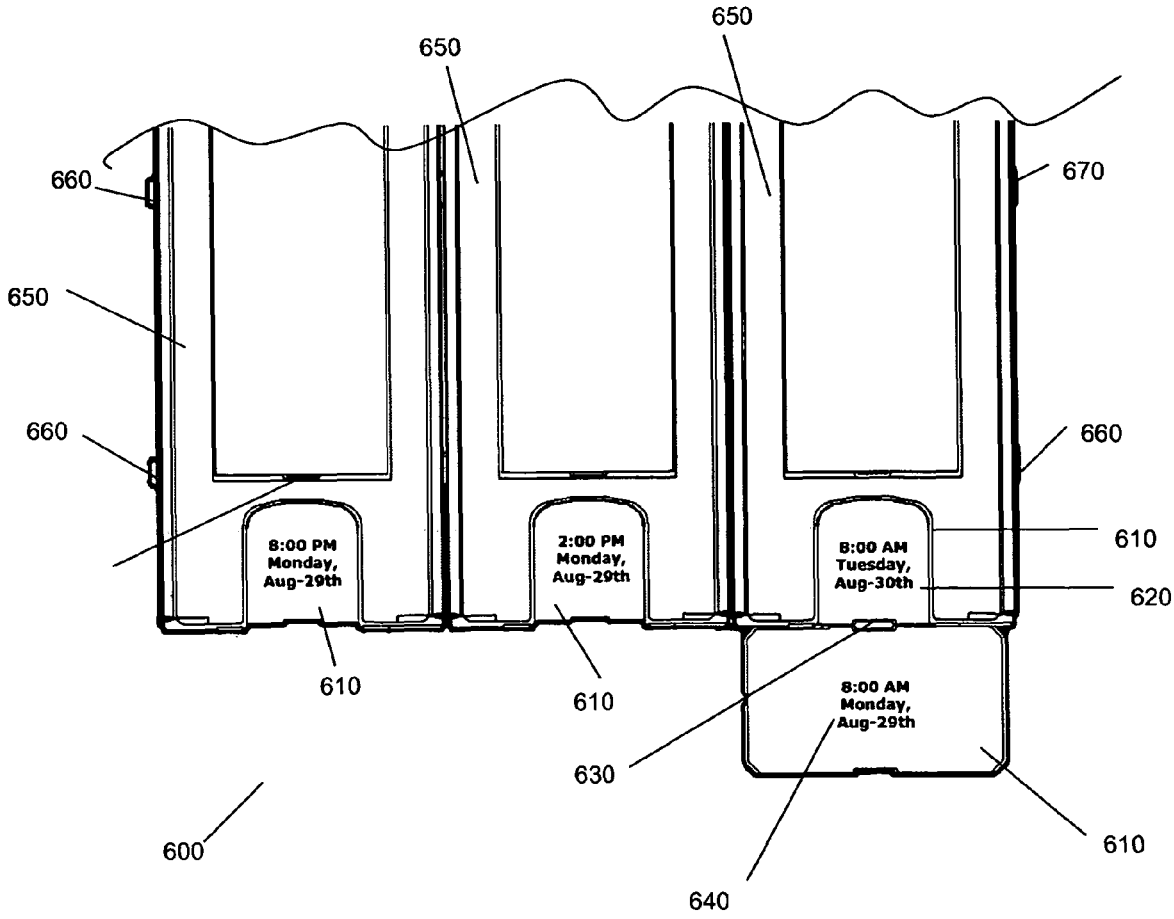

FIG. 12 is a partial view of one embodiment of a pill assembly comprising interlocking secondary sleeves in accordance with the invention.

Figure 13:
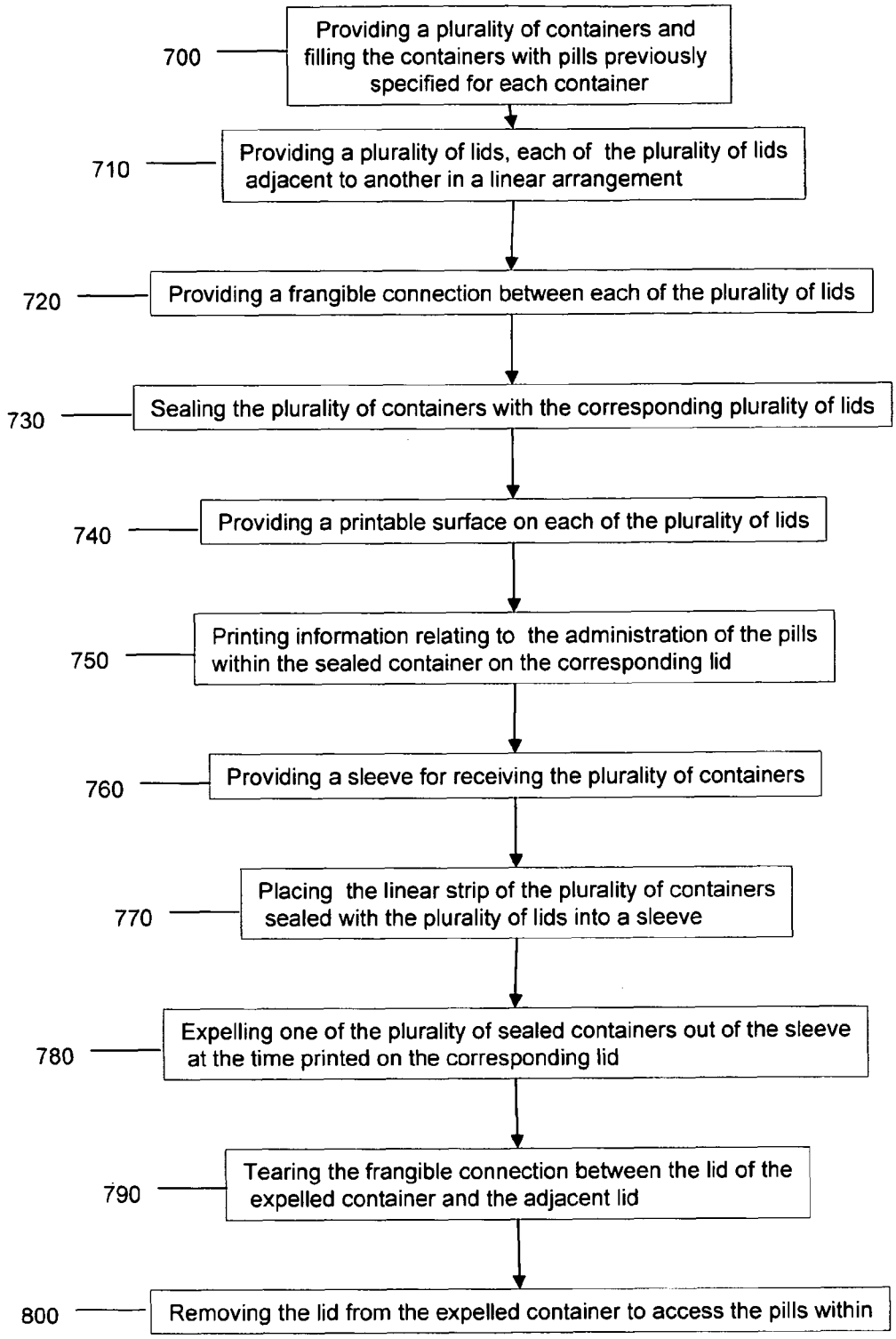

FIG. 13 is a flow chart of one embodiment of a method of dispensing pills to a patient using a pill assembly.

Figure 14A:
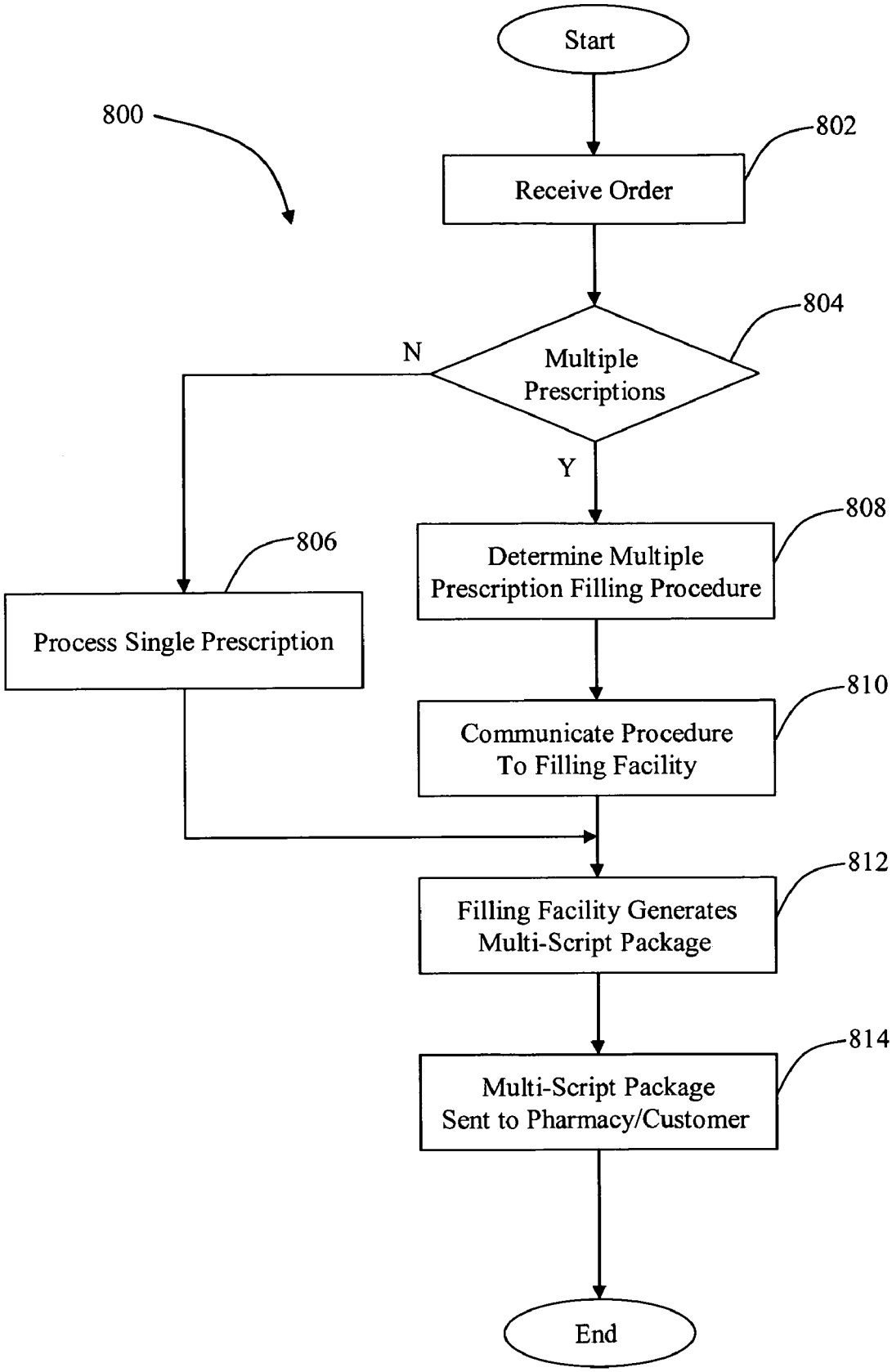
Figure 14B:
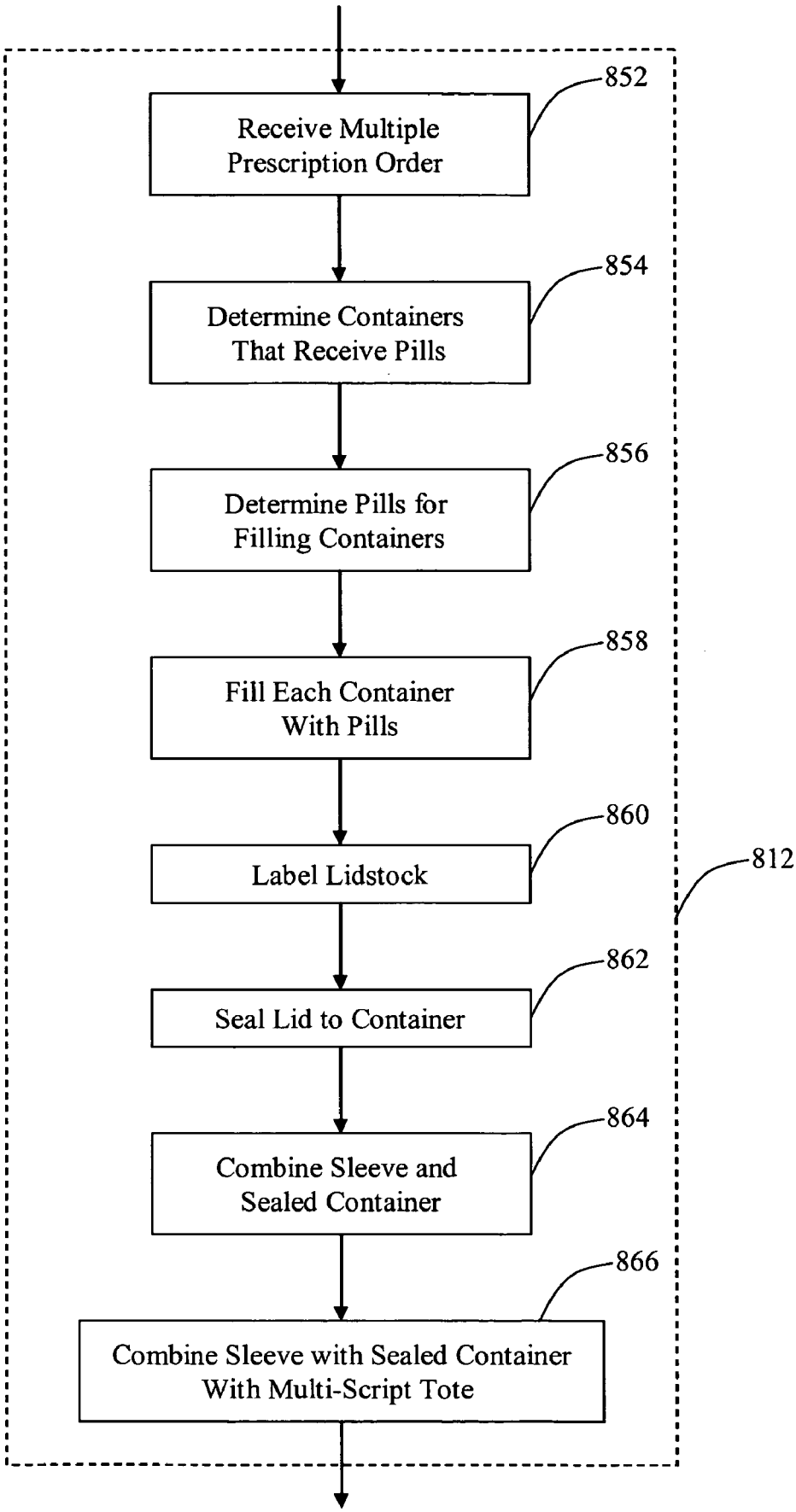

FIGS. 14*a* and 14*b* is a flow chart of one embodiment of a pill delivery and packaging system for manufacturing a pill assembly in accordance with the invention.

FIG. 15 shows an illustrative Graphical User Interface for receiving on-line orders.

DESCRIPTION

Before the present assembly, apparatus and methods are described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned herein are incorporated herein by reference to disclose and describe the methods and/or materials in connection with which the publications are cited.

Figure 1:
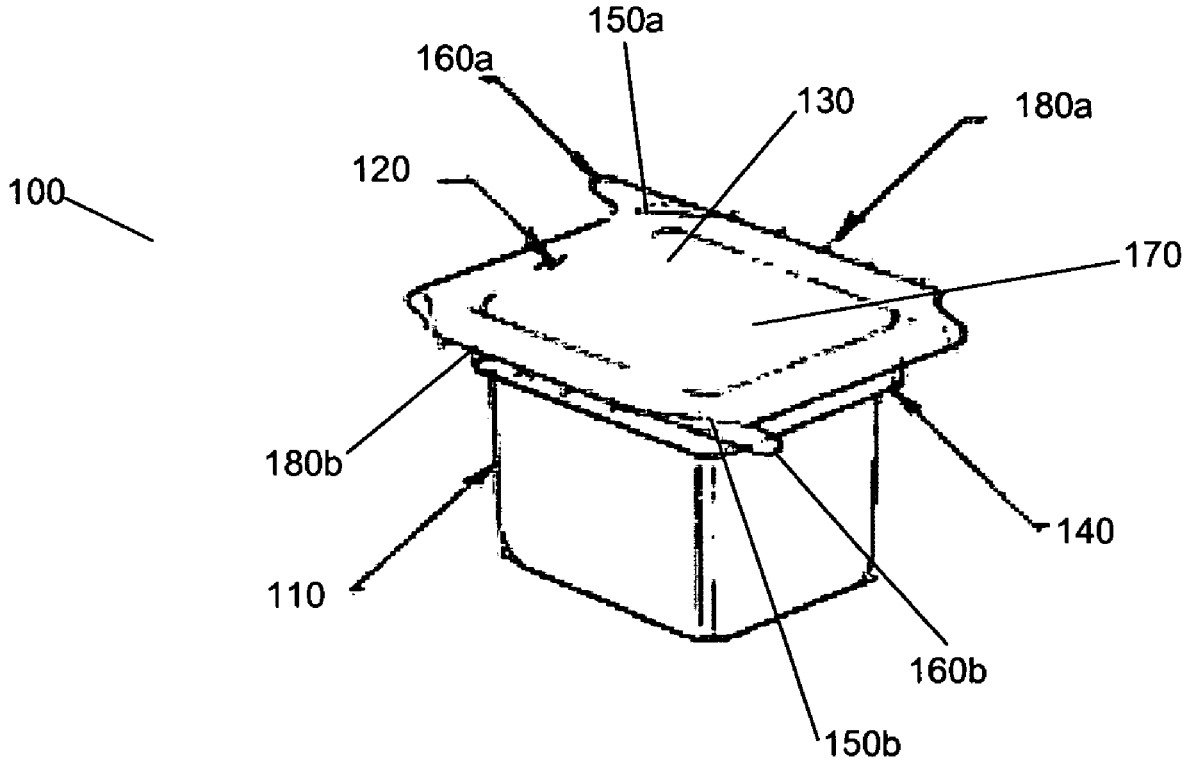
FIG. 1 shows a diagram of one embodiment of a container and a lid.

Referring to FIG. 1 there is shown a diagram of one embodiment of a pill assembly for holding pills. It should be noted that what is meant by a "pill" is a small article which is swallowed. In general, a pill may be a prescription medication, supplements, or any other such article that is intended to be ingested to improve a user's health or wellbeing. A pill may also be medication in the form of a suppository, or vitamins, herbal supplements and the like. In this embodiment, the pill assembly 100 comprises a tapered body container 110 with a cavity for holding a plurality of pills. The container 110 has a flanged top surface 120 configured to be sealed with a lid 130. In this application, the combination of an individual container sealed with a lid or a plurality of individual containers with lids is referred to as a "delivery container", not to be confused with an individual container. The individual container 110 also comprises a stackable shoulder 140, allowing a plurality of individual containers to be stacked for storage. In certain embodiments, the pill assembly may require individual containers that vary in depth depending on the amount of pills needed to be dispensed at a specific time. While the depth of the individual containers may vary, the flanged top surface and shoulder remain constant for processing of different sized individual containers and for commonality with the assembly sleeve.

The lid 130 shown in FIG. 1 is configured to attach or adhere to the flanged top surface 120 of the individual container 110. The flanged top 120 shown in FIG. 1 further comprises a plurality of chamfered regions 150*a* and 150*b*, allowing the lid 130 to overhang the chamfered regions 150*a* and 150*b* of the individual container for easy lid removal by the patient. Lid 130 is preferably a laminated film which is heat sealed onto the flanged top 120 of the individual container 110. Lid 130 further comprises peel tabs 160*a* and 160*b* which extend out past the chamfered regions 150*a* and 150*b*, respectively, making the lid 130 peel able and to facilitate in the opening of the pill assembly 100. Lid 130 also comprises a writing surface 170 where patient data, container content and prescription information can be placed. Lid 130 further comprises perforation lines (i.e. frangible connections) 180*a* and 180*b*, which allow a plurality of lids to be connected to one another (not shown in FIG. 1).

The individual container 110 of the pill assembly is preferably manufactured from clear or tinted plastic to allow viewing of the pills within. The individual container(s) may be made by thermoforming or injection molding techniques. Exemplary plastics utilized for the individual container comprise but are not limited to polyphenysulphone, polystyrene, polypropylene, as well as polyethylene.

Figure 2:
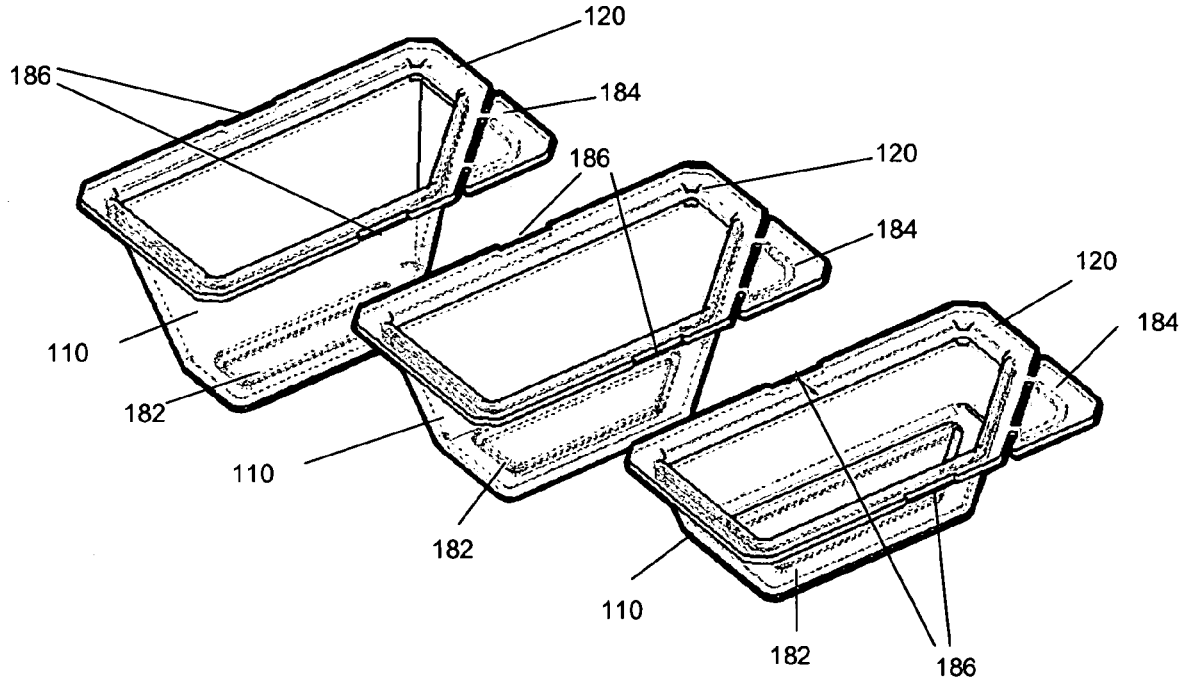
FIG. 2 shows a diagram of one embodiment of a container in various sizes.

Referring now to FIG. 2, is a diagram showing one embodiment of a container 110 of various depths. The three individual containers shown in FIG. 2 are identical except for the depth of the cavity of the containers. The flanged top surface 120 and the bottom surface 182 are the same on all three containers shown in FIG. 2, and are configured to make the various sizes of containers stackable. The containers 110 further comprises a breakaway tab 184 on the sealing flange 120. The tab provides a handhold for easy opening and peeling back the lid from the container. The containers 110 also comprise a plurality of indentations 186 on at least one edge of the flanged top surface 120 to aid in connection of the containers 110.

Referring now to FIGS. 3*a* and 3*b*, there is shown a top view and a bottom view of another embodiment of a pill assembly 200 comprising a plurality of individual containers 110 connected together by a plurality of lids 130. The lids 130 of the individual containers 110 are sequentially connected to one another with perforations 180 in between. Once the lids 130 are attached and/or sealed to the top flanged surfaces 120 of containers 110, this sequential connection enables a linear configuration of the individual containers 110. However, it should be noted that the quantity of containers in a pill assembly is variable as well as is the interconnection configuration of the containers (e.g. a circular, an elliptical, polyhedral, etc.)

instead of a linear configuration. In general, what is meant by "assembly" is the fitting together of manufactured parts into a complete machine, structure, or unit of a machine.

The lid 130 of each container 110 comprises a printing surface 170 in which unique prescription-specific information is displayed for each container in the pill assembly. The information displayed on printing surface 170 may include but not be limited to, the patient's name, the date and the day of the week the contained mixed dosage medications (pills) are to be taken, as well as the time of day that the pills are to be taken. The net effect of the pill assembly 200 shown in FIGS. 3*a* and 3*b*, is a single continuous strip of pill-filled, individual containers that are joined together by the perforated joints of the lid stock (e.g. a plurality of lids 130 connected together). The markings on the containers inform the patient and/or caregiver the time in which the contents of the container are to be taken in the proper sequence. In general, the lid stock comes from a roll and the appropriate amount of lidstock is released from the roll to accommodate the designated number of containers to be sealed. For a thermoformed container, using polypropylene for the material for the lid stock, an unsealed area of lid film is generally used to help in the peeling of the lid. The breakaway tab 184 on the container gives the user something to hold onto and is a useful feature to a container that is manufactured by injection molding with plastics like polyethylene or styrene.

Referring now to FIG. 4, there is shown a diagram of one embodiment of a pill assembly comprising a dispensing sleeve. In this embodiment, the pill assembly 200 in FIGS. 3*a* and 3*b*, further comprises a dispensing sleeve or secondary sleeve 220 for packaging of the articles/pills placed inside the individual container(s) 110. The secondary sleeve 220, is configured to connect to a plurality of containers 110 when the containers are connected or sealed to a plurality of lids 130. The secondary sleeve 220 comprises grooves or slits 230*a* and 230*b* configured to allow the flanged top surface 120 of each container 110 and the non-perforated edges (shown in FIGS. 1 and 3*a*) of each lid 130 to slide into the secondary sleeve 220 through grooves 230*a* and 230*b*. The embodiment shown in FIG. 4 comprises seven individual containers 110, one for each day of the week.

The secondary sleeve 220 is configured to comprise several features which are necessary for a device utilized for dispensing pharmaceuticals. In the embodiment shown in FIG. 4, the secondary sleeve 220 comprises a thumb groove 240, which is configured preferably for a human thumb or finger, allowing a patient or caregiver easy access to the medications in the end container 250, under thumb groove 240 of the pill assembly. The thumb groove 240 also acts as a display window to allow the patient to view the printed markings on lid 260 connected to the end container 250 which contains the next medication to be taken from the pill assembly. The secondary sleeve 220 also contains a printable area 270 large enough to accommodate required patient prescription labeling.

The secondary sleeve 220 of the pill assembly embodiment shown in FIG. 4, further comprises integral, mold-in release tabs 280*a* and 280*b* configured to allow the individual container 250 to move out of the secondary sleeve 220 when pressure is applied to release tabs 280*a* and 280*b*. Container 250 is then removed from the pill assembly by breaking the perforation mark on the lid stock between container 250 and the adjacent individual container 290. The release tabs are configured to "catch" the second container 290 in the strip of containers, so that only one container 110 is released from the secondary sleeve 220 at a time. A pill assembly with at least one release tab 280*a* or 280*b* on the secondary sleeve provides a "child resistance" feature, important to the pharmaceutical industry.

The dispensing sleeve 220 may be injection molded or manufactured from plastics such as polypropylene and ABS. The dispensing sleeve 220 shown in FIG. 4 is produced as one piece and is configured to lock onto another sleeve with a "snap and lock" means comprising at least one cavity 292 and at least one protruding section 294 of the dispensing sleeve 220.

FIG. 5*a* shows an exploded top view of a pill assembly prior to the attachment of the dispensing sleeve 220 to the group of containers 110. The exploded view shown in FIG. 5 also shows a lock tab 299 on the top surface 270 of the sleeve which locks the end container 250 in place by catching in the rectangular void made by one of the indentations 186 on container 250 and one of the indentations 186 on container 290 when they are adjacent to one another other. When the user pushes down the end container 250 with their thumb, lock tab 299 is disengaged from the containers and end container 250 can be slid out of the dispensing sleeve 220 if there are no other child protective features on the pill assembly.

FIG. 5*a* also shows one embodiment of a pill assembly where printed material 296 maybe attached to the top surface 270 of the dispensing sleeve 220. Additional information about the prescription or other patient data can be placed on the dispensing sleeve 220.

Referring to FIG. 5*b*, there is shown a label that can be coupled to the dispensing sleeve 220. The illustrative label is a folded label that includes a picture of a particular patient, which by way of example is named Martha Jones. The illustrative folded label also includes a picture of the pills that have been prescribed to Martha Jones. Furthermore, there may be additional unique information about the patient printed on the label, such as her doctor's name and telephone number, and possible allergies related to the patient. The folded label may be used by a caregiver, to help make sure that the appropriate prescriptions are being dispensed to the particular patient, e.g. Martha Jones. Additionally, there may be particular information about each pill on the folded label that may include manufacturer's latest labeling information, and this information may be presented in a manner similar to the Physician's Desk Reference, which includes a color picture of the pill with a summary about the pill. In one illustrative embodiment, the label includes the latest information about side effects, warnings, and proper use of each pill, with an accompanying drawing of the pill. Additionally, the illustrative label includes a picture of each pill and the accompanying text is adjacent to the picture of the pill.

FIG. 6 is a bottom view of the pill assembly shown in FIG. 5 prior to enclosing the containers with the dispensing sleeve 220. This perspective shows a dispensing sleeve 220 with a first end 300 and a second end 302. The first end 300 comprises notches 304*a* and 304*b* and a sleeve 220 holding the first container 250 when the sleeve 220 is closed as in FIG. 4. The second end 302 of the sleeve 220 is configured to prevent the containers 110 from slipping out of the sleeve from the second end 302 of the sleeve. The "snap and lock" features 292 and 294 are also shown in FIG. 6.

FIG. 7 is a partial view of one embodiment of a pill assembly showing a child protective feature in accordance with the invention. The first end 300 of the sleeve 220 comprises release tabs 280*a* and 280*b* configured on the sides of the sleeve. The release tabs 280*a* and 280*b* each comprise a molded loop 308*a* and 308*b* configured to hold the top flanged surface 120 of the end container 250 in the dispensing sleeve 220. The molded loops 308*a* and 308*b* have concave sections

310*a* and 310*b* which contact the bottom side of the top flanged surface 312. When the end container 250 is to be taken out of the secondary sleeve, the downward pressure of the user's thumb on the lid of container 250 in the thumb well pushes the concave section 310*a* and 310*b* downward, releasing the top flanged surface from the release tabs 280*a* and 280*b*, allowing container 250 to exit the secondary sleeve 220.

Other embodiments of the release tab(s) on the sleeve of a pill assembly are a molded-in pinch release tab and a push-down release tab different from the embodiment shown in FIG. 7. Both configurations work in a one way, "ratchet/stop" motion in conjunction with each container when the release tab is actuated. FIG. 8*a* and 8*b* show diagrams of one embodiment of a molded-in pinch release tab and one embodiment of a push down release tab, respectively.

Referring to FIG. 8*a* there is a diagram showing a bottom view of one embodiment of a pill assembly 320 with two molded-in pinch release tabs, 322*a* and 322*b*. Release tabs 322*a* and 322*b* are positioned at the same end 323 of the secondary sleeve 324 as a thumb groove 326. Each pinch release tab, 322*a* and 322*b* is connected to release arms 328*a* and 328*b* by molded hinges 330*a* and 330*b*. When release tabs 322*a* and 322*b* are pushed inwards towards the secondary sleeve 324, the molded hinges 330*a* and 330*b* release arms 328*a* and 328*b* so the arms 328*a* and 328*b* move away from the secondary sleeve 324. Then the end individual container 332 of the strip of individual containers is free to be pushed out of the secondary sleeve end 323. Once the individual container 332 is positioned outside the secondary sleeve 324, the container 332 can be released from the pill assembly by breaking the perforation mark 334 on the lid stock positioned between containers 332 and 336. The release arms 328*a* and 328*b* are configured to lock the next container 336 in the secondary sleeve once pressure has been released from the pinch release tabs 322*a* and 322*b*. The pinch release tabs shown in FIG. 8*a* are textured to enhance gripping the pinch release tabs with ones fingers. Other configurations of pinch release tabs utilize different features to achieve the same result, such as a pinch release tab that is concave, or angular. The molded-in pinch release tab is only one configuration of a container release feature for a pill assembly and many other container release configurations known by those skilled in the art of designing and manufacturing release tabs may be utilized.

For example, FIG. 8*b* shows a diagram of a partial side view of another embodiment of a pill assembly 340 comprising a container release feature. In this embodiment, the secondary sleeve 342 comprises at least one offset molded release spring 344 positioned near the same end of the secondary sleeve 342 as the thumb groove (not shown in FIG. 8*b*). The secondary sleeve 342 further comprises a tab 346 or overhang 346 and also a slot 348 on the same end of the secondary sleeve 342 as the thumb groove. The offset spring 344 is configured to release the flanged top surface 350 of container 352 from the secondary sleeve 342 when a downward pressure is applied to the release spring 344, allowing the flanged top surface 350 of the container 352 to be depressed sufficiently to exit through slot 348. The release spring 344 is configured to return to its original position when downward pressure is removed, pushing the top flanged surface in an upward manner, locking the strip of containers in the secondary sleeve 342 with tab 346 and release spring 344.

In some embodiments, the pill assembly comprises a plurality of secondary sleeves joined together to assist the patients and/or caregivers in the administration of prescriptions that need to be taken at different times during the same day (e.g. 6:00 am, 1:00 pm, 9:00 pm, etc.). The sleeves comprise a lock and key feature which allows a plurality of sleeves to be interlocked together.

Referring now to FIG. 9*a* and 9*b*, these two diagrams show one embodiment of a pill assembly with a plurality of secondary packages or sleeves connected to a plurality of containers strips. In this embodiment, the pill assembly 360 comprises three secondary sleeves or secondary packages 362, 364 and 366, each comprising container strips 370, 372 and 374 format in FIG. 9*a*. A strip of seven individual containers 368 is a preferable design for daily usage on a per week basis. Therefore, grouped sleeves 362, 364 and 366 can be compiled for patients that need to take multiple prescriptions more than once per day. FIG. 9*b* shows a secondary sleeve prior to enclosing a strip of containers. While FIG. 9*b* only shows secondary sleeve 362, sleeves 364 and 366 also comprise the features for interlocking a plurality of sleeves together. Sleeve 362 comprises a plurality of knobs or hooks 376 on a first side 378 of the sleeve 362 and a plurality of corresponding shaped grooves or knob receptacles 380 on a second side of sleeve 382, which enables the first side of sleeve 364 to interlock with the second side of sleeve 362. In a similar manner sleeve 364 interlocks to sleeve 366.

Referring now to FIG. 10*a* and 10*b*, these two diagrams show one embodiment of a pill assembly with a plurality of secondary packages or sleeves connected to a plurality of containers strips. In this embodiment, the pill assembly 400 comprises three secondary sleeves or secondary packages 410, each comprising seven individual containers, configured in container strip 420 format in FIG. 10*a*. A strip of seven individual containers is a preferable design for daily usage on a per week basis. Therefore, grouped sleeves 410 can be compiled for patients that need to take multiple prescriptions more than once per day. Each sleeve 410 comprises a knob 430 on a first side of the sleeve 410 and a corresponding circular shaped groove or knob receptacle 440 on a second side of the sleeve 410, which enables knob 430 to slide into the circular shaped groove 440, interlocking the first and second sides of the sleeves 410 together.

FIG. 10*b* shows an end view of a secondary sleeve 410 holding a container strip 420 of the pill assembly 400 embodiment shown in FIG. 10*a*. In FIG. 10*b*, the knob 430 and the knob receptacle 440 of the sleeve 410 interlocking device is seen in more detail. The pill assembly 400 also comprises a thumb relief or groove 450 as well as container release features comprising retaining tabs 460*a* and 460*b* and molded springs 470*a* and 470*b*, similar to the push down release embodiment shown in FIG. 4 and 8*b*. Those skilled in the art shall appreciate that other container release elements may be to utilized with a pill assembly comprising interlocking secondary sleeves.

In the above embodiments as well as others, the individual containers in container strips contain some additional special design features that enhance their handling characteristics in storage and on the packaging system and equipment utilized for producing the pill assembly. Some dosages of medications will contain significantly more tablets than others. In the interests of efficient container material usage, and to prevent the smaller tablet dosages from excessively rattling around within the container, the containers are supplied in a plurality of sizes; however, the sizes only vary in their depth dimensions. The length and width dimensions of all sizes, along with the shape and size of the top flanged surface, remain constant for all sizes of container. This is to facilitate efficient operation of the equipment for producing the pill assemblies by minimizing the need for size changeovers. Also, the bodies of the containers are designed with tapered outer surfaces such that they will closely nest within each other when empty. Therefore, they can be supplied in vertical stacks that take up significantly less room while being stored as well as enabling efficient magazine feeding when they are being processed within the pill assembly packaging equipment.

Referring now to FIG. 11, is a diagram of one embodiment of a "senior friendly" pill assembly. In this embodiment of a pill assembly, no secondary dispenser/sleeve is utilized since there is not a requirement for a "child resistant" feature. When a family of packaging dispensers is produced, one of the package designs in the family is allowed by law to be "senior friendly." The objective of a "senior friendly" pill assembly is to provide an uncomplicated and easy to open pill dispenser. The senior friendly embodiment still contains desirable design features that eliminate the possibilities of human error affecting the correct applications of the drug dosages. Like the two part pill assembly (i.e. delivery container and secondary sleeve) described above, the senior friendly embodiments comprise the features of the fail-safe pill dispensing features, but without the "child safety" feature. Additionally, with this embodiment there are three panels for labeling. The larger labeling area enables the use of larger print (making it senior friendly).

The pill assembly for the medications in this embodiment is a multi-cavity unit that can be either thermoformed or injection molded (the illustrated unit is injection molded). In the illustrative embodiment shown in FIG. 11, the basic unit 500 of the pill assembly comprises seven individual cavities (only one cavity 510 is clearly shown in FIG. 11) in a linear arrangement; however, other shapes and number of cavities are possible (i.e., a circular pattern of cavities, an elliptical pattern, a polyhedral pattern, etc.). The cavities are connected to one another by a top surface 520 of the pill assembly 500. The pill assembly 500 further comprises a side support 530 connected to the top surface 520 to lend stability to the pill assembly as well as allowing the pill assembly to be stackable for storage purposes.

The correct mixed dosage of tablets for each successive application of the drugs is placed into each cavity in sequential order, either manually or by an automatic pill dispensing system. A strip of laminated film lid stock 540, containing seven successive lids or panels 550, each panel 550 separated by perforations 560, is heat sealed to the top surface 520 and the side support 530 of each cavity 510 in such a manner that each lid stock panel 550 seals a separate cavity. Therefore, each cavity contains a sealed-in dosage of tablets, in sequential order, that is specific to the time that it is to be taken. The lid stock panel for each cavity is labeled, in the same corresponding successive and sequential order. By way of example and not of limitation, the lid stock panel comprise the name of the patient, the date, the day of the week, and time, relating to the dosage within the cavity that the lid covers.

This "senior friendly" embodiment of the pill assembly comprises a larger lid stock 540 and a larger pull tab 570 than the other pill assembly embodiments previously described. The geometry of the perforations 560 in relation to the sealed lid stock panels 550, are such that the perforation line 560 is located over a narrow, unsealable indented linear line (not shown in FIG. 11) configured on the top surface 520 and the side support 530 that is essentially parallel to and between the sealable sections of the two adjacent cavities. There are notches 580 along one side of the pill assembly that are centrally located extended from the end of each perforation line in such a manner that the unsealed corners of the panels 550 (at the perforations 560) extend over each notch 580. Each set of two adjacent panels are fully slit for the depth of the notch back to the perforation, thus enabling the corner of the proper panel to be grasped, pulled upward, and peeled back along the perforations while still leaving the adjacent panel sealed in place (see FIG. 11). The patient simply peels off each successive panel exposing the proper medication on the date and time printed in the print area 590 of each panel 550. Thus, there is no confusion about the type of medication and when the medications should be taken.

The basic unit 500 of the pill assembly comprises features which enhance the storage and equipment handling properties of the unit. The side support(s) and end surfaces of the basic unit 500 are tapered in such a way that the units can be nested within each other and stacked to preserve space both in storage and within the packaging machinery. Anti-lock nesting ledge or tab features may also be included for ease of handling. To accommodate different quantities of tablet dosages, the units are supplied in different sizes, where only the depth dimensions vary. The shape and size of the top surface and the length and width dimensions for the unit remain constant for all sizes.

Like the embodiments shown in FIGS. 9*a* and 10*a*, FIG. 12 is a diagram showing yet another embodiment of a pill assembly useful for patients which must take medications more than once a day. The pill assembly 600 comprises a plurality of thermoformed (or molded) individual container/packages 610 where the correct dosages of tablets are sequentially placed and then heat seal closed with a laminated lid 620 from a lid stock roll. The lid 620 for each container 610 is connected to the adjacent container and separated by perforations 630 forming a container strip (not shown). In the illustrative embodiment shown in FIG. 12, each of the three container strips comprise seven containers 610. Each container 610 in the strip contains printed markings 640 that identify the medications contained therein, and may also indicate the patient's name, and, most importantly for the purposes of this embodiment, the day and the time of day that the medications are to be taken. All of these features of the pill assembly shown in FIG. 12 are essentially the same as those described in FIGS. 3, 4 and 9*a*. However, one distinction between the illustrative embodiment shown in FIG. 12 and the embodiment described in FIG. 4 is that each strip of containers is dedicated solely to a particular time of day. In FIG. 4, each container is associated with a particular day (i.e. Monday thru Sunday, sequentially). Hence, it is possible to have a plurality of container strips of daily medications for each week such that each separate strip contains only the proper dosage that is to be taken at the same time of the day on each successive day of the week, in essence forming a matrix: medication time X day of the week. (e.g., the contained medications are to be taken at 8:00 AM on Sunday, Monday, Tuesday, etc.). Another strip might be for administration at a different time on each of the same days (e.g., at 2:00 PM).

In this illustrative embodiment, the patient is supplied with a complete set of strips (one complete set of strips per week) containing all of the proper medications for that week for a specific time of day. Each individual package and/or container 610 within each container strip is to be taken at the correct, prescheduled time each day as marked on the individual package. The pill assembly 600 may be issued to the patient or caregiver as three separate strips of containers enclosed in three separate secondary containers 650. The patient or caregiver can interlock the three separate secondary sleeves 650 in a specified order (i.e. earliest medication time to last medication time) as described above by locking the hooks 660 of one secondary sleeve to the corresponding opening or grooves 670 of an adjacent sleeve.

An illustrative method for the dispensing of medications utilizing the embodiments of the pill assembly is described in the flowchart in FIG. 13. In general, the methods for dispensing pills comprise providing a plurality of containers that are adjacent to one another and filling each container with specified pill(s) for a specific patient, and then sealing the plurality of containers with a corresponding plurality of lids. The general method further comprises printing or writing on a printable surface of each of the plurality of lids, the printing on each lid providing information about the time and/or date the medication in the corresponding sealed container is to be administered.

Referring to FIG. 13 there is shown a flow chart showing one embodiment of the method for dispensing pills which utilizes a secondary package or sleeve for receiving a plurality of containers. This embodiment of the method for dispensing pills comprises providing a plurality of containers 700 that are adjacent to one another and filling each container with at least one pill previously specified for each container. The method may also comprise providing a plurality of lids that may be adjacent to one another in a linear arrangement 710. The configuration of the lids is not limited to a linear arrangement and may be configured in any manner as to be capable of sealing the plurality of containers. The method further comprises providing a frangible connection (e.g. perforated line) between each of the plurality of lids 720. The frangible connection may be a thinned region of plastic that is easily breakable, perforations in the film (with no other connections between the individual containers) and the like.

The method comprises sealing the plurality of containers with the corresponding plurality of lids 730. The quantity of the containers in the pill assembly is variable, depending on the prescription of the patient. The number of lids will correspond to the number of containers utilized in the pill assembly. A printable surface is provided on each of the plurality of lids 740 in which specific printing indicia or information is placed 750 relating to the administration of the pills held in the container sealed by the corresponding lid.

This method may also comprise providing a sleeve or secondary package for receiving the plurality of sealed containers 760 and placing the group or strip of the plurality of containers sealed with the plurality of lids into the sleeve 770. The patient completes the process of dispensing the pills by expelling or manually moving one of the plurality of sealed containers out of the sleeve at the time printed on the corresponding lid 780. Once the container has been slid out from the secondary package, the container is removed from the strip of containers as well as the secondary package and/or sleeve by tearing the frangible connection between the lid of the expelled container and the adjacent lid remaining in the sleeve 790. The patient can then gain access to the pills in the expelled container by removing the lid for the container 795. In some alternative embodiments, the method comprises providing extended tabs on the lids, break-away tabs and/or providing chamfered edges on the container to make removing the lid off of the container more convenient.

In yet another embodiment, the method further comprises providing a child safety release tab on a secondary sleeve as seen on the pill assembly embodiment shown in FIG. 4, to prevent unwanted tampering of the pills in the containers by children. In this embodiment, at the proper time for dispensing the pills from a container, the patient holds the dispenser and manually actuates the release tabs while simultaneously manually sliding the strip of containers in a direction "out of the dispenser." When the perforations or frangible connection between the first two containers in the strip reach the outer edge of the dispenser the release tab resets, thus locking the strip from further sliding motion. The patient then tears off, at the perforations, the protruding container that contains the correct medications for the stated time, pulls up on the extended corner of the lid, and opens the container by peeling back the lid, exposing the medications. The dispenser then is left with the correct printed markings showing in the thumb groove display window (see FIG. 12), ready for the next dosage to be taken.

Other embodiments of the methods of dispensing pills comprise, providing a "senior friendly" pill assembly instead of an assembly with a child safety tab for the convenience of patients with limited dexterity.

While the present invention has been described with reference to the specific embodiments thereof, it should be understood by those skilled in the art that it is to be understood that the foregoing is a detailed description of illustrative embodiments. The scope of the claims is not limited to these specific embodiments or examples. Various elements, details, execution of any methods, and uses can differ from those just described, or be expanded on or implemented using technologies not yet commercially viable, and yet still be within the inventive concepts of the present disclosure. The scope of the invention is determined by the following claims and their legal equivalents.

Referring to FIGS. 14*a* and 14*b* is a flow chart of one illustrative embodiment of a pill delivery and packaging system for manufacturing a pill assembly. The pill delivery and packaging system, in general, is a semi-automated system for filling prescriptions utilizing the pill assemblies described above. The pill delivery and packaging system 800 begins when an order for a prescription is received 802. A order may be already in a prescription data base or may be placed over the telephone or internet and then submitted to the prescription database of a pill delivery system. The prescription order is analyzed or queried if the prescription is a multiple prescription 804. If the order prescribes only one type of pill or medication, the prescription is processed as a single prescription 806 and then packaged by the filling facility at block 812 and then sent out. If the prescription comprises multiple medications, a multiple prescription filling procedure 808 is determined by a computer of the pill delivery system for that particular order. The system determines how many individual containers are necessary, the size of the container(s), what type and how many pills are to be placed in each container. The system also determines how many containers to place in a secondary sleeve as well as the printed material that needs to be applied to each lid for a specific container as well as printed material to be applied to the secondary sleeve. The multiple prescription filling procedure, which is also referred to as "multi-script", for a specific prescription is then communicated to the filling facility 810. The filling facility may comprise a plurality of filler modules with various medications configured to place a specified pill into a predetermined container of a pill assembly. Once the filling facility has received the correct filling procedure for a prescription, the filling facility generates a multiple prescription package 812, i.e. a multi-script package, for the appropriate prescription, utilizing a pill assembly in accordance with the invention. The process and system for generating a multi-script package 812 is described in more detail in the flow chart shown in FIG. 14*b*. Once the multi-script package is prepared, the prescription is configured and addressed to be shipped out to the customer or pharmacist at block 814.

FIG. 14*b* is a flow chart of the one embodiment of the process and system used for generating multi-script packages at the illustrative filling facility described in block 812 above. At 852, the filling facility receives information on the procedure needed to fill a multiple prescription order. The filler facility configures the right size containers 854 in a specified order to be filled with a particular pill or pills 856. The containers may be stored in stackable units and the filler facility may comprise a container de-nesting subsystem configured to organize the individual containers for filling. In certain embodiments, the containers may be placed on a conveyor belt type system which allows the containers to travel along the conveyor system to the designated filler module containing the correct medication. The containers may also be placed on trays configured to hold a plurality of containers and situated on a conveyor system which allows the filling facility to track the position of each container within the filling facility. Once the containers are chosen and placed in a predetermined order, filler modules comprising the correct medication are activated and the containers are filled with the specified pill(s) 858. The containers filled with medication are then transferred to a lid stock substation where a label has been printed on the lid 860 which is specific for a particular container. The filling facility may be configured to inspect the pills in each container for accuracy by a pharmacist and/or automated system. Once the containers have been inspected, the lid is sealed on to the container 862. For example, the lidstock may be thermo-sealed connecting a plurality of lids with a plurality of containers, resulting in a strip of containers similar to that shown in FIG. 3*a*. In the embodiment described in FIG. 14*b*, the pill assembly comprises at least one dispensing sleeve and the strip of containers is enclosed in the dispensing sleeve 864. When the multiple prescription order comprises more than one combined sleeve and strip of containers, the sleeve may be labeled indicating the order in which the sleeves need to be interlocked together by the user. In other instances, the filling facility is configured to interlock a plurality of sleeves in an order prior to sending it to the user. Finally, the combined sleeve with sealed containers is combined with a multi-script tote or bag 866 for shipment to the patient or a predetermined pharmacy.

Referring to FIG. 15 there is shown an illustrative Graphical User Interface (GUI) for receiving on-line orders using the Internet. The illustrative GUI includes fields for the name of the patient, address, telephone number and e-mail of the user. Additional information about the patient such as date, height, weight, and sex can also provided to the illustrative GUI. The user can input information about the patient's particular medical condition, information about the patient's doctor, drug allergies, and current medications being taken by the patient. Furthermore, the user may provide specific ordering options such as instructing that child resistant packaging not be used for the illustrative senior patient. Data fields are also provided for identifying the requested medications or product, the desired dosage, the desired quantity, and the type of drug. The type of drug may include information about whether the drug is generic or name brand. If the product is available, the on-line ordering system would then provide a price for the product. A sub-total is then provided, and shipping costs are identified. A final order total is then presented to the user. The patient may then provide a credit card, a debit card or any other such information for conducting an on-line transaction. The name of the patient, the number of the card, the type of card and the expiration date of the card are requested in the illustrative embodiment.

What is claimed is:

1. A pill assembly, comprising:

a multiple prescription order corresponding to a particular patient, where it includes a plurality of different medications that are administered during a particular time of day, wherein each medication is associated with a pill;

a strip that includes a plurality of containers that are adjacent to one another, wherein each of the containers receives by automatic means the plurality of different medications;

each container having a top surface with a flange thereon;

an automatically printed lid stock that includes a plurality of lids wherein each lid is configured to interface with the flange of the container, each of the plurality of lids is configured to seal each associated container, and each lid has printed information thereon;

a sleeve that is configured to slidably interface with the strip, the sleeve including a groove that is configured to slidably interface with the flanged top surface of the sealed containers;

a label coupled to the sleeve associated with the particular patient, wherein the label has printed information thereon;

a release tab disposed on the sleeve, configured to enable a sealed container to be released from the sleeve; and a frangible connection between each of the sealed containers, wherein the sealed container is removed from the strip by breaking the frangible connection.

2. The pill assembly of claim 1 wherein the sleeve further comprises a first side having a cavity that is configured to interlock with a second side having a protruding section so that when a first sleeve is adjacent to a second sleeve, the first side of the first sleeve is configured to interlock with the second sleeve.

3. The pill assembly of claim 1 wherein each of said plurality of containers further comprises a breakaway tab.

4. The pill assembly of claim 1 wherein said plurality of containers further comprises different sized cups.

5. The pill assembly of claim 1 further comprising a thumb groove on a front end of the sleeve that enables the time of day to be visible when the plurality of medications are to be administered.

6. The pill assembly of claim 1 wherein the sleeve comprises a thumb groove configured to interface with a human thumb so that the sealed container can be removed when the two release tabs are pressed.

7. An apparatus for storing pills, comprising:

a multiple prescription order corresponding to a particular patient, where it includes a plurality of different medications that are administered during a particular time of day, wherein each medication is associated with a pill;

a strip that includes a plurality of containers that are adjacent to one another, wherein each of the containers receives by automatic means the plurality of different medications;

each container having a top surface with a flange thereon;

an automatically printed lid stock that includes a plurality of lids wherein each lid is configured to interface with the flange of the associated container, each of the lids is configured to seal each associated container, and each lid has printed information thereon;

a sleeve configured to slidably interface with the strip, the sleeve including a thumb groove on a front end of the sleeve that enables the time of day to be visible when the plurality of medications are to be administered;

a label coupled to the sleeve, wherein the label includes printed information about the plurality of different medications and each pill in the containers; and two release tabs disposed on the sides of the sleeve configured to release the strip from the sleeve.

8. The apparatus of claim 7 wherein the thumb groove is configured to interface with a thumb so that the sealed container can be removed when the two release tabs are pressed.

9. The apparatus of claim 7 wherein the sleeve further includes a first side having a cavity configured to interlock with a second side having a protruding section so that when a first sleeve is adjacent to a second sleeve, the first side of the first sleeve is configured to interlock with the second sleeve.

10. The apparatus of claim 7 wherein said plurality of containers is grouped for a seven-day period.

11. The apparatus of claim 7 wherein said plurality of containers further comprises different sized cups.

12. The apparatus of claim 7 wherein each of said plurality of lids further comprises a breakaway tab.

13. The apparatus of claim 7 further comprising a frangible connection between each of the sealed containers.

14. A pill assembly system for associating a plurality of different medications that are administered during a particular time of day to a particular patient, wherein each medication is associated with a pill, the pill assembly system comprising:

a plurality of containers that are adjacent to one another, wherein each of the containers receives by automatic means a plurality of different medications;

a multiple prescription order including the plurality of different medications and corresponding to a particular patient, wherein the plurality of different medications are administered during a particular time of day;

a flange affixed on a top surface of each container;

an automatically printed lid stock that includes a plurality of lids wherein each lid is configured to interface with the flange of the container, allowing each of the plurality of lids to be configured to seal each container and each lid to have printed information thereon;

a sleeve configured to slidably interface with the plurality of containers, the sleeve including a groove that is configured to slidably interface with the flanged top surface of the sealed containers;

a label coupled to the sleeve, the label associated with the particular patient, wherein the label will receive printed information thereon;

release tabs disposed on either side of the sleeve, configured to enable a sealed container to be released from the sleeve; and a frangible connection between each of the sealed containers.

15. A pill assembly system of claim 14 wherein the sleeve further comprises a first side having a cavity that is configured to interlock with a second side having a protruding section so that when a first sleeve is adjacent to a second sleeve, the first side of the first sleeve will interlock with the second sleeve.

16. A pill assembly system of claim 14 wherein each of the plurality of containers further comprises a breakaway tab.

17. A pill assembly system of claim 14 wherein said plurality of containers further comprises different sized cups.

18. A pill assembly system of claim 14 further comprising a thumb groove on a front end of the sleeve that enables the time of day to be visible when the plurality of medications are administered.

19. A pill assembly system of claim 14 wherein the sleeve comprises a thumb groove configured to interface with a human thumb so that the sealed container can be removed when the two release tabs are pressed.

20. A pill assembly system of claim 14 wherein said plurality of containers is grouped for a seven-day period.

* * * * *